US007335120B1

(12) United States Patent
Pittner

(10) Patent No.: US 7,335,120 B1
(45) Date of Patent: Feb. 26, 2008

(54) STRING TENSION IDENTIFICATION DEVICE AND METHOD

(76) Inventor: Dusan Pittner, 119 Randall St., Easton, MA (US) 02356

( * ) Notice: Subject to any disclaimer, the term of this patent is extended or adjusted under 35 U.S.C. 154(b) by 213 days.

(21) Appl. No.: 11/185,172

(22) Filed: Jul. 21, 2005

Related U.S. Application Data

(60) Provisional application No. 60/628,485, filed on Nov. 16, 2004.

(51) Int. Cl.
*A63B 49/00* (2006.01)
*A63F 71/06* (2006.01)

(52) U.S. Cl. ..... 473/553; 473/522; 273/DIG. 26

(58) Field of Classification Search ..... 473/553, 473/522, 524; 434/205, 207, 188, 210; 116/327, 116/335; 283/36, 81, 48.1, 49; 40/913, 40/915; 273/DIG. 26
See application file for complete search history.

(56) References Cited

U.S. PATENT DOCUMENTS

| | | | | | |
|---|---|---|---|---|---|
| 168,395 | A * | 10/1875 | Harris | 116/323 |
| 1,081,815 | A * | 12/1913 | de La Rosa | 434/199 |
| 1,535,737 | A * | 4/1925 | Price | 235/1 R |
| 1,723,648 | A * | 8/1929 | Hawes | 283/48.1 |
| 1,790,994 | A * | 2/1931 | McCook | 116/326 |
| 1,984,839 | A * | 12/1934 | Murray | 116/200 |
| 4,172,595 | A * | 10/1979 | Sewell | 473/553 |
| 4,738,449 | A * | 4/1988 | Droz | 473/553 |
| 4,841,653 | A * | 6/1989 | Negley | 40/625 |
| 4,881,758 | A * | 11/1989 | Ben-David | 283/102 |
| 4,982,627 | A * | 1/1991 | Johnson | 81/121.1 |
| 5,022,651 | A * | 6/1991 | Barone | 473/522 |
| 5,048,452 | A * | 9/1991 | Haddock et al. | 116/225 |
| 5,106,086 | A * | 4/1992 | Acosta | 473/522 |
| 5,190,319 | A * | 3/1993 | Sandler | 283/102 |
| 5,485,996 | A * | 1/1996 | Niksich | 473/549 |
| 5,489,122 | A * | 2/1996 | Pittner | 283/49 |
| 5,498,158 | A * | 3/1996 | Wong | 433/102 |
| 6,082,227 | A * | 7/2000 | Vogel | 81/119 |
| 6,195,830 | B1 * | 3/2001 | Bruschi | 15/143.1 |
| 6,257,098 | B1 * | 7/2001 | Cirone | 81/119 |
| 6,279,958 | B1 * | 8/2001 | Santa Cruz et al. | 283/65 |
| 6,668,751 | B1 * | 12/2003 | Henke | 116/200 |
| 6,912,937 | B2 * | 7/2005 | Tuanmu | 81/119 |
| 2006/0286515 | A1 * | 12/2006 | Heil | 434/207 |

FOREIGN PATENT DOCUMENTS

DE 3124101 A1 * 1/1983

* cited by examiner

*Primary Examiner*—Raleigh W. Chiu
(74) *Attorney, Agent, or Firm*—William Nitkin

(57) ABSTRACT

A racquet string tension identification device and method for mounting on a stringed racquet utilizing a color coding system to denote the original string tension range in tens of pounds and having nine indicia areas with the number of additional pounds of tension to be added to the tension range depending upon how many of such indicia areas are marked.

16 Claims, 2 Drawing Sheets

STRING TENSION IDENTIFICATION DEVICE AND METHOD

This application claims priority and benefit of a provisional patent application entitled S.T.I.C., Stringing Tension Identification Code New Accessory for All Racquet Sports, Ser. No. 60/628,485 filed Nov. 16, 2004, now pending.

BACKGROUND OF THE INVENTION

1. Field of the Invention

The invention relates to a device and method for displaying the string tension of a racquet and in one embodiment for acting as a vibration dampener and more particularly relates to a device and method of use that has code indicia thereon to indicate the original string tension of the racquet.

2. History of the Prior Art

Racquets are utilized in many sports such as tennis, badminton, squash, racquet ball and the like and for serious players it is desirable to preserve the information as to the original string tension of a racquet. This information is important to players who may own many racquets and choose the racquet having a particular string tension for any given game based on such factors as weather and court conditions as well as other playing conditions.

It is also well known in the prior art to have devices which fit between the strings of the string bed for vibration dampening. These devices can have advertising on them. An example of such prior art is U.S. Pat. No. 4,761,007 to Boschian which is typical of the prior art wherein a circular or slightly oblong disk-like device made of an elastic material having grooves on the sides thereof is inserted within an opening formed by the longitudinal and transverse strings such that it is maintained in place by its engagement to the strings. Such devices can have weights therein to act as a vibrating element to aid in the cancellation of vibrations in the racquet. Other vibration-dampening devices are disclosed in U.S. Pat. No. 6,447,411 to Bianchi; U.S. Pat. No. 6,033,324 to Nashif et al; U.S. Pat. No. 5,871,409 to Kimoto; U.S. Pat. No. 5,651,545 to Nashif et al; and U.S. Pat. No. 4,927,143 to Hillock. Typical of these vibration dampeners is that they attach on a generally unused area on the strings near the throat grommet of the racquet.

Also well known in the prior art is the fact that the original string tension of a racquet can be printed on a label and attached to racquet. There are limitations as to where such stickers can be placed on a racquet; and some racquets, such as badminton, squash and some racquet ball racquets, have frames that are too narrow to receive attachable labels.

Many players seek ideal racquet string tension in their racquets, and achieving an ideal string tension can often be a long and complicated process based on a fine tuning method. The process can consist of a lot of trial and error and requires substantial experience. Each player starts off stringing his racquet within a "recommended tension" range provided for each racquet by the manufacturer. For example, the common range for tennis racquets is 55-65 lb. of tension; for badminton racquets, 20-25 lb. of tension; for squash racquets, 25-30 lb. of tension; and for racquet ball racquets, 30-35 lb. of tension. Tennis racquets potentially can be strung at tension ranges from a low of 40 lb. of tension to a high of 80 lb. of tension. However, string tension is altered by many factors such as heat, cold and humidity. For example, a tennis racquet that is strung at 65 lb. of tension which is left inside a car on a hot summer day will have its tension lowered by several pounds. Most serious players have multiple racquets and have their string tension set within a limited range. For example, a tennis player may choose to string one of his racquets at 62 lb. of tension, another at 64 lb. of tension, and yet another at 66 lb. of tension, such range of string tensions allows the tennis player to choose a racquet having an appropriate string tension depending on his style of play, court conditions, and/or weather conditions for a given day.

SUMMARY OF THE INVENTION

It is an object of this invention to provide a fast, easy and economical means of aiding in identifying the racquet string tension of a particular racquet. The methodology and device of this invention enables a player to easily identify racquets of different string tensions and choose the proper racquet based on his needs, such as playing conditions, training program, and technical improvement requirements and for the racquet to then easily and conveniently display its string tension utilizing a color code system to display string tension for all types of racquets by indicia which are displayed for indicating a particular string tension.

In one embodiment the device of this invention can also be utilized as a vibration dampener, fitting in between the strings within slots formed in the sides thereof. In another embodiment the device of this invention can be incorporated into a racquet end cap.

DESCRIPTION OF THE PREFERRED EMBODIMENT(S)

Figure 1:
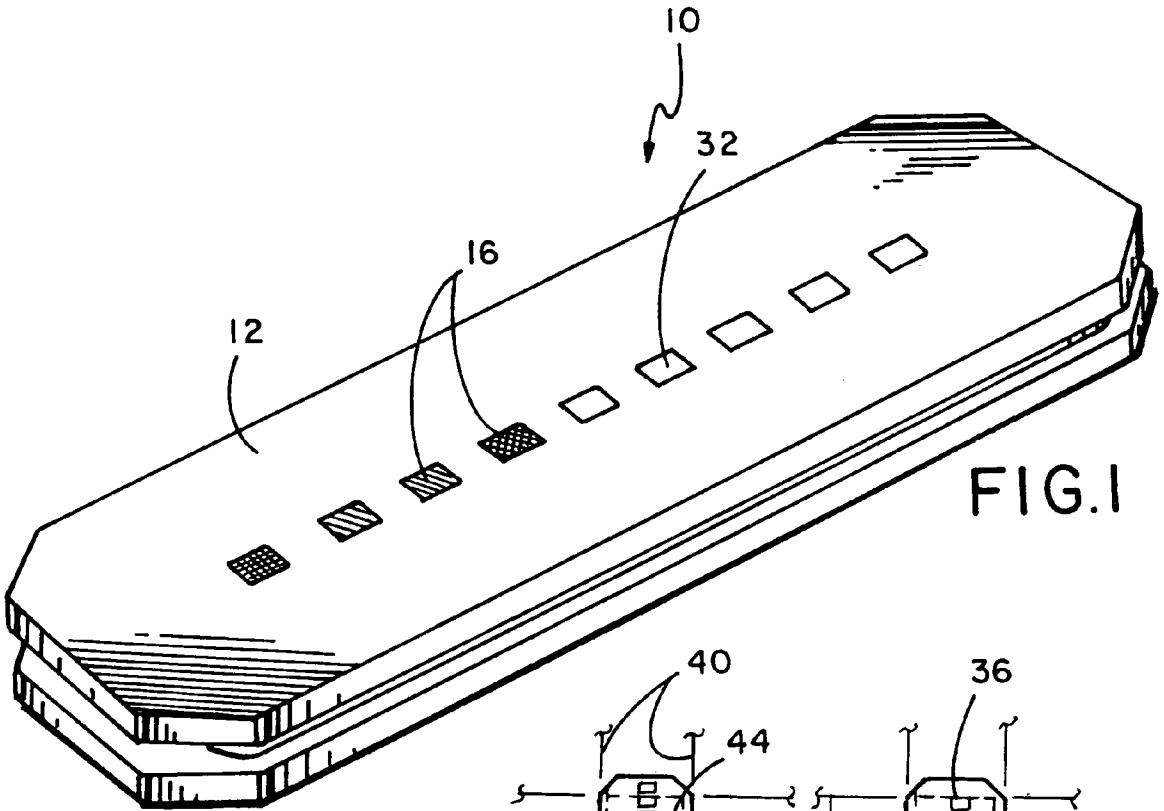
FIG. 1 illustrates an enlarged perspective view of one embodiment of the string tension identification device of this invention.
Figure 2:
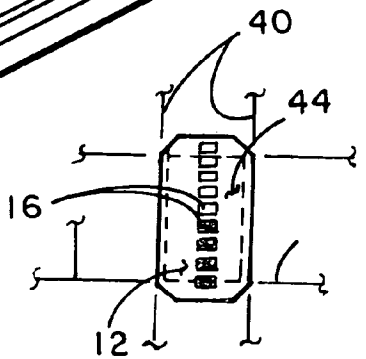
FIG. 2 illustrates a front view of the device of FIG. 1 disposed within the strings of a racquet near the throat of the racquet.
Figure 3:
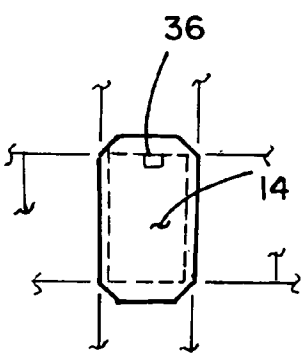
FIG. 3 illustrates a rear view of the device of FIG. 2.
Figure 4:
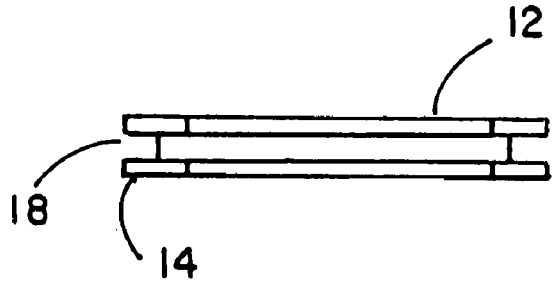
FIG. 4 illustrates a side view of the device of FIG. 2.
Figure 5:
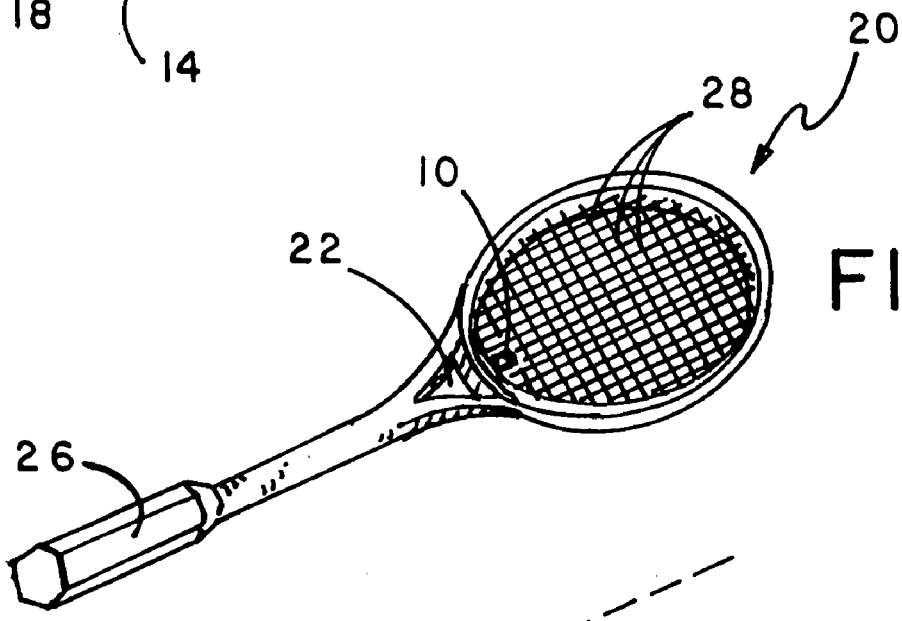
FIG. 5 illustrates a perspective view of a tennis racquet showing the various parts thereof and the area of attachment of one embodiment of the device of this invention.
Figure 6:
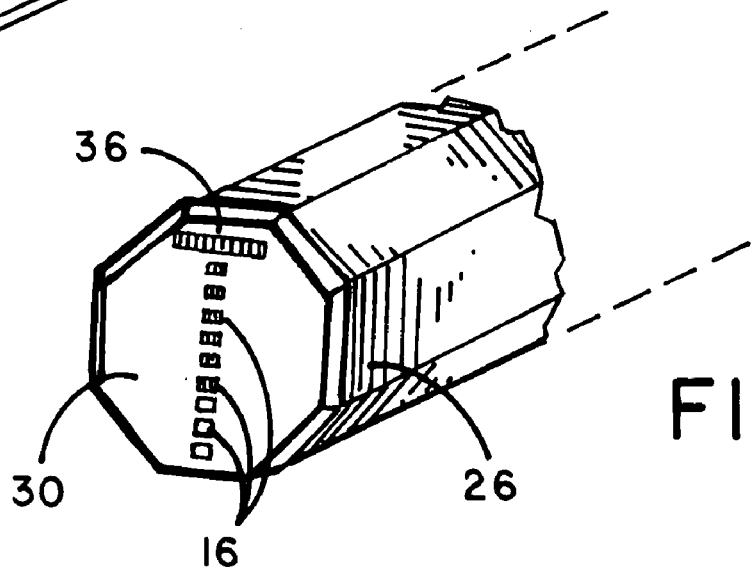
FIG. 6 illustrates a perspective view of a racquet handle showing another embodiment of the device of this invention incorporated into a racquet end cap.

In one embodiment, as shown in FIGS. 1 and 4, the device of this invention can be a generally planar member 10 made of a resilient material having a front face 12 and rear face 14 and generally four sides having slots 18 defined therein for receipt of four strings of racquet 20. Such device is designed to fit within an opening 44 in the strings of a racquet formed by the intersection of a pair of adjacent longitudinal strings 40 and a pair of adjacent transverse strings 42, as seen in FIG. 2. The device of this invention is thus interengaged between the strings and held in place within slots 18 of the device by the strings and the resiliency of the material out of which the device is made, causing it to be manipulable into opening 44 in the mesh 28 of the strings to act as a vibration dampener while at the same time providing a string tension identification code thereon. A series of color marking indicia are disposed on the front and rear faces of the device of this invention. A string tension identification code 36 is disposed on rear face 14 which utilizes colors to denote specific tension ranges where, for example, a white mark represents a 10-19 lb. of tension range; a yellow mark represents a 20-29 lb. of tension range; an orange mark represents a 30-39 lb. of tension range; a red mark represents a 40-49 lb. of tension range; a purple mark represents a 50-59 lb. of tension range; a blue mark represents a 60-69 lb. of tension range; a green mark represents a 70-79 lb. of tension range; and a black mark represents an 80-89 lb. of tension range. The coding system of this invention in this embodiment utilizes both the front face 12 and rear face 14 of the device of this invention. The rear of the device is marked with one small color square 36, as seen in FIG. 3, the color of which represents the tension range of the particular racquet's strings. For example, if square 36 in FIG. 3 is blue, such color code represents the 60 lb. tension range. Front face 12 of the device has a series of nine small squares 16 running vertically in a column up the middle of the device with each square representing one pound of tension. In FIG. 2 a certain number of the nine squares appears in color or darkened, and the remainder are uncolored. One counts the number of colored or darkened squares, where "colored" or "darkened" is used interchangeably herein, which number combined with the tension range shown on the rear face, indicates the original string tension of the racquet. For example, in FIG. 1 there are four darkened squares which indicate four pounds of tension which are added to the 60 lb. tension range of the blue square 36 on rear face 14 so that the original string tension of the tennis racquet would be precisely 64 lb. If none of the squares on the front face of the device are darkened, then the string tension of the racquet would be 60 lb. Therefore the string tension of a racquet can be quickly determined by first examining the rear face of the device to determine the tension range. Then by examining the front face of the device to see how many additional pounds of tension are indicated by the darkened squares, one adds the total number of such darkened squares to the tension range indicated on the rear face to arrive at the string tension of the racquet. Once a racquet is strung to a particular tension, the device is set with the information color code thereon and the device is inserted into string bed 28 to allow a player to know exactly the string tension of his racquet when it was originally strung. The string tension identification code can be displayed in other ways on a racquet. For example, it can be shown displayed on a single side of a device, such as on an end cap 30 mounted on the butt cap of racquet handle 26, as seen in FIG. 6, with the tension range code 36 being denoted in a larger block and the additional pounds of tension displayed in a column of nine indicia squares 16. Thus the color coding system can work in the same way where the tension range indicia is in a position where it can be associated with the additional pounds of tension indicia.

The device of this invention can be useful to other people coming in contact with a racquet on which the device is mounted, such as coaches, relatives, or friends to assist them in choosing a racquet having a desired string tension. Further, the device is useful should a racquet need re-stringing. The person re-stringing the racquet can quickly determine the original string tension for that racquet when that racquet is being repaired.

Although the present invention has been described with reference to particular embodiments, it will be apparent to those skilled in the art that variations and modifications can be substituted therefor without departing from the principles and spirit of the invention.

I claim:

1. A racquet string tension identification device for mounting on a stringed racquet having longitudinal and adjacent transverse strings forming a plurality of openings therebetween, said racquet having a handle and a butt end, comprising:

a substantially planar member having four sides, each of said sides having a length, each of said sides having a slot defined along its respective length, said member made of resilient material for insertion into one of said openings, said slots for receiving said strings surrounding one of said openings for retaining said member in place on said racquet;

a coding system disposed on said member for indicating string tension, such coding system including:

a single string tension range color marker for denoting a string tension range in tens of pounds, said color selected from a plurality of colors each representing a string tension range in tens of pounds; and nine indicia areas which, depending on the number of such indicia areas that are marked, such marked indicia areas indicating the number of additional pounds of tension to be added to the pounds of tension indicated by the single string tension range color marker to calculate the total pounds of string tension of said racquet.

2. The device of claim 1 wherein said string tension range color marker is disposed on said member adjacent to said nine indicia areas.

3. The device of claim 2 wherein said string tension range color marker is larger than each of said nine indicia areas and each of said nine indicia areas is of like size and said nine indicia areas are arrayed in a column.

4. The device of claim 1 wherein said member has at least a first face and a second face and said string tension range color marker is displayed on said first face and said nine indicia areas are displayed arrayed on said second face.

5. The device of claim 4 wherein said nine indicia areas are arrayed in a column.

6. A racquet string tension identification device for mounting on a stringed racquet, said racquet having a handle and a butt end, comprising:

a member; and a coding system disposed on said member for indicating string tension, such coding system including:

a single string tension range color marker for denoting a string tension range in tens of pounds, said color selected from a plurality of colors each representing a string tension range in tens of pounds;

nine indicia areas which, depending on the number of such indicia areas that are marked, such marked indicia areas indicating the number of additional pounds of tension to be added to the pounds of tension indicated by the single string tension range color marker to calculate the total pounds of string tension of said racquet;

wherein said member has at least a first face and a second face, said string tension range color marker is displayed on said first face, and said nine indicia areas are displayed arrayed in a column on said second face; and wherein said member is a vibration dampener having a front face and a rear face and wherein said string tension range color marker and nine indicia areas are disposed, respectively, on said front and rear faces of said vibration dampener.

7. A racquet string tension identification device for mounting on a stringed racquet, said racquet having a handle and a butt end, comprising:

a member; and a coding system disposed on said member for indicating string tension, such coding system including:

a single string tension range color marker for denoting a string tension range in tens of pounds, said color selected from a plurality of colors each representing a string tension range in tens of pounds;

nine indicia areas which, depending on the number of such indicia areas that are marked, such marked indicia areas indicating the number of additional pounds of tension to be added to the pounds of tension indicated by the single string tension range color marker to calculate the total pounds of string tension of said racquet:

wherein said string tension range color marker is disposed on said member adjacent to said nine indicia areas; and wherein said member is an end cap for placement on said butt end of said handle of said racquet and wherein said string tension range color marker and said nine indicia areas are arrayed on said end cap.

8. The device of claim 7 wherein said string tension range color marker is larger than each of said nine indicia areas, wherein each of said nine indicia areas is of like size and wherein said nine indicia areas are arrayed in a column.

9. A method of indicating the string tension of a stringed racquet having a handle and a butt end, comprising the steps of:

providing a string tension range color marker for indicating tens of pounds of tension range of said strings of said racquet;

selecting said color from a plurality of colors, each representing a string tension range in tens of pounds;

coloring the string tension range color marker with the appropriate tension range of said racquet;

providing nine indicia areas for indicating additional single pounds of tension of said strings of said racquet;

marking selected of said nine indicia areas to denote additional pounds of string tension to be added to said pounds of tension indicated on said string tension range color marker; and determining the original string tension of said racquet by adding together the number of pounds of tension indicated by said string tension range color marker and the number of pounds of tension indicated by the number of the nine indicia areas marked.

10. The method of claim 9 further including the steps of:

providing a member having at least one surface and arranging said string tension range color marker thereon; and disposing said nine indicia areas on said surface.

11. The method of claim 10 further including the step of arraying said nine indicia areas in a column.

12. The method of claim 10 further including the steps of:

providing an end cap for placement on said butt end of said handle of said racquet; and arranging said string tension range color marker and said nine indicia areas on said end cap.

13. The method of claim 12 further including the step of arraying said nine indicia areas in a column.

14. The method of claim 9 further including the steps of:

providing a vibration dampener disposed on said strings of said stringed racquet, said vibration dampener having a first face and a second face; and disposing said string tension range color marker on said first face and said nine indicia areas on said second face.

15. The method of claim 14 further including the step of arraying said nine indicia areas in a column.

16. The method of claim 9 further including the step of mounting said marker on said racquet.

* * * * *